US008021212B2

(12) United States Patent
Chida et al.

(10) Patent No.: US 8,021,212 B2
(45) Date of Patent: Sep. 20, 2011

(54) APPARATUS FOR POLISHING EDGE SURFACE OF GLASS SUBSTRATE FOR MAGNETIC RECORDING MEDIA, AND PROCESS FOR PRODUCING GLASS SUBSTRATE

(75) Inventors: Shohei Chida, Pranakornsri Ayutthaya (TH); Masami Kaneko, Chiyoda-ku (JP); Mitsuhiko Komakine, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 12/396,191

(22) Filed: Mar. 2, 2009

(65) Prior Publication Data

US 2009/0227187 A1 Sep. 10, 2009

Related U.S. Application Data

(63) Continuation of application No. 11/398,653, filed on Apr. 6, 2006, now abandoned.

(30) Foreign Application Priority Data

Apr. 7, 2005 (JP) ..... 2005-111104

(51) Int. Cl.
*B24B 1/00* (2006.01)

(52) U.S. Cl. ..... 451/44; 451/28; 451/56

(58) Field of Classification Search ..... 451/28, 451/41, 43, 44, 54, 55, 56, 242, 246, 254, 451/255, 256, 527
See application file for complete search history.

(56) References Cited

U.S. PATENT DOCUMENTS

| | | | |
|---|---|---|---|
| 5,087,481 | A | 2/1992 | Chen et al. |
| 5,538,579 | A | 7/1996 | Ishimura et al. |
| 5,569,518 | A | 10/1996 | Hayashi |
| 5,871,654 | A | 2/1999 | Mannami et al. |
| 5,900,296 | A | 5/1999 | Hayashi et al. |
| 5,926,352 | A | 7/1999 | Murayama et al. |
| 6,363,599 | B1 | 4/2002 | Bajorek |
| 6,394,888 | B1 | 5/2002 | Matsumoto et al. |
| 6,664,503 | B1 | 12/2003 | Hsieh et al. |
| 6,718,612 | B2 | 4/2004 | Bajorek |
| 6,795,274 | B1 | 9/2004 | Hsieh et al. |
| 6,829,910 | B1 | 12/2004 | Hsieh et al. |
| 6,863,947 | B2 | 3/2005 | Kaneko |
| 6,949,485 | B2 | 9/2005 | Nakashima et al. |
| 6,992,858 | B2 | 1/2006 | Kaneko |
| 2001/0049031 | A1 | 12/2001 | Bajorek et al. |

(Continued)

FOREIGN PATENT DOCUMENTS

| | | | |
|---|---|---|---|
| CN | 1368912 | A | 9/2002 |

(Continued)

*Primary Examiner* — Eileen P. Morgan
(74) *Attorney, Agent, or Firm* — Oblon, Spivak, McClelland, Maier & Neustadt, L.L.P.

(57) ABSTRACT

An apparatus for polishing an edge surface of a glass substrate for magnetic recording media. The apparatus includes a grindstone including abrasive grains mixed with a resin. The grindstone is configured to polish at least the edge surface of the glass substrate. The grindstone has a reentrant groove with a bottom surface and sidewall surfaces such that the bottom surface of the reentrant groove contacts the edge surface of the glass substrate and the sidewall surfaces of the reentrant groove contacts chamfered sidewalls of the glass substrate. The reentrant groove and sidewall surfaces are formed in the resin of the grindstone by pressing the glass substrate into the resin of the grindstone with a force higher than a pressing force during polishing.

3 Claims, 4 Drawing Sheets

U.S. PATENT DOCUMENTS

| | | | |
|---|---|---|---|
| 2002/0037687 | A1 | 3/2002 | Yamahara |
| 2002/0197437 | A1 | 12/2002 | Hashimoto et al. |
| 2003/0082999 | A1 | 5/2003 | Yoshikawa et al. |
| 2003/0175471 | A1 | 9/2003 | Kaneko |
| 2003/0194954 | A1 | 10/2003 | Bonner et al. |
| 2003/0232586 | A1 | 12/2003 | Ramanath et al. |
| 2004/0082290 | A1 | 4/2004 | Yoshida et al. |
| 2004/0194508 | A1 | 10/2004 | Nishimoto et al. |
| 2005/0101230 | A1 | 5/2005 | Yoshikawa et al. |
| 2005/0142321 | A1 | 6/2005 | Miyahara et al. |
| 2006/0039080 | A1 | 2/2006 | Kaneko |
| 2006/0061901 | A1 | 3/2006 | Miyahara et al. |

FOREIGN PATENT DOCUMENTS

| | | |
|---|---|---|
| JP | 2002-160170 | 6/2002 |

APPARATUS FOR POLISHING EDGE SURFACE OF GLASS SUBSTRATE FOR MAGNETIC RECORDING MEDIA, AND PROCESS FOR PRODUCING GLASS SUBSTRATE

This application is a continuation of U.S. Ser. No. 11/398,653 filed Apr. 6, 2006 the entire content of which is incorporated herein by reference, and claims priority under 35 U.S.C. 119 to Japanese Application No. JP 2005-111104 filed Apr. 7, 2005.

The present invention relates to an apparatus for polishing an edge surface of a glass substrate for magnetic recording media and a process for producing a glass substrate. Particularly, it relates to an apparatus for polishing an edge surface of a glass substrate for magnetic recording media and a process for producing a glass substrate, designed to polish an outer edge surface of a glass substrate for hard disks made of glass substrate as the base material.

As a substrate for hard disks to be mounted for personal computers, various information recording devices, etc. in recent years, attention has been drawn to one made of glass excellent in planarization and substrate strength rather than one made of Al (aluminum).

Such a glass substrate for hard disks is processed into a doughnut-type circular shape, and after such processing into a circular shape, its outer edge surface is subjected to chamfering by a grindstone such as an electrodeposited grindstone. However, the surface roughness of the outer edge surface after such chamfering is as rough as about 200 nm by arithmetic average roughness (Ra), and there was a problem such that if it was attempted to transfer it in such a state to a process step for the production of hard disks, when the glass substrate was in contact with a cassette for transportation or with various jigs, particles were likely to be formed as dusts from the edge surface, etc. of the glass substrate thus leading to manufacturing defects. Further, with the rough surface, washing efficiency was poor, and there was a drawback that dirt or stain on the outer edge surface was hardly removable thus leading to contamination-type defects.

Patent Document 1 discloses an apparatus for polishing glass substrates, wherein at the time of polishing outer peripheral edge surfaces of glass substrates, a plurality of glass substrates are laminated and cased by passing a shaft through center holes of the respective glass substrates, and this substrate case is rotated by a rotary driving device, and a rotary glass made of nylon is rotated and pushed against the outer edge surfaces of the plurality of rotating glass substrates, while an abrasive such as cerium oxide is supplied, to polish the outer edge surfaces of the glass substrates. It is thereby possible to polish the outer edge surfaces of the glass substrates to a level of about 10 nm by arithmetic average roughness (Ra).

Patent Document 1: JP-A-12-185927

However, the polishing apparatus disclosed in Patent Document 1 had drawbacks such that lamination and separation of the glass substrates were required to be carried out by manual operation, and not only extra time and effort were required, but also scars were likely to result during the handling. Further, in order to meet the requirement for improvement in precision for removal of surface defects in recent years, when the glass substrates were to be laminated, it was necessary to insert a spacer made of resin between adjacent glass substrates for every substrate, which also led to a drawback of requiring extra time and effort. Further, recently, there is a tendency that the dimensional tolerance of the inner and outer diameters tends to be severe, and by the polishing apparatus disclosed in Patent Document 1, variations were observed in the processing margin among the laminated glass substrates, and to reduce such variations, it was sometimes necessary to carry out an operation of reversing the lamination order of laminated substrates in the middle of processing, which led to a drawback of requiring further time and effort.

Furthermore, the depth of damages (scars) due to processing by an electrodeposited grindstone, forming the roughness, is from 10 to 20 μm from the surface of the glass substrate, and in order to reduce the surface roughness after processing by such an electrodeposited grindstone, it is necessary to polish it with a processing margin of at least the depth of such damages. However, by a polishing apparatus designed mainly for polishing by free abrasive grains employing an abrasive such as cerium oxide, like the polishing apparatus disclosed in Patent Document 1, the polishing rate tends to be substantially low. Therefore, in order to secure the productivity, it is necessary to increase the number of substrates to be treated per batch by laminating a large number of glass substrates. However, if the number of laminated substrates is increased, processing margins and variations within the batch will be large. Accordingly, there was a problem such that as mentioned above, an extra operation of e.g. reversing the lamination order of the laminated substrates in the middle of processing was required.

The present invention has been made under these circumstances, and it is an object of the present invention to provide an apparatus for polishing an edge surface of a glass substrate for magnetic recording media, whereby formation of scars due to handling can be prevented, and the productivity can be improved without requiring extra effort.

To accomplish the above object, the present invention provides the following:

1. An apparatus for polishing an edge surface of a glass substrate for magnetic recording media, characterized in that an outer edge surface and/or an inner edge surface of a glass substrate for magnetic recording media is polished by pressing said outer edge surface and/or said inner edge surface against a grindstone made of resin, prepared by mixing abrasive grains to a resin, so that the arithmetic average roughness (Ra) of said outer edge surface and/or said inner edge surface would be at most 100 nm.

2. An apparatus for polishing an edge surface of a glass substrate for magnetic recording media, which comprises a first station to carry out mounting and dismounting of the glass substrate, a second station to carry out grinding of an outer edge surface and/or an inner edge surface of the glass substrate, a third station to carry out polishing of the outer edge surface and/or the inner edge surface of the glass substrate, and a transfer mechanism to transfer the glass substrate mounted at the first station sequentially via the second station and the third station to the first station, wherein at the third station, the outer edge surface and/or the inner edge surface of the glass substrate is polished by pressing said outer edge surface and/or said inner edge surface against a grindstone made of resin, prepared by mixing abrasive grains to a resin, so that the arithmetic average roughness (Ra) of said outer edge surface and/or said inner edge surface would be at most 100 nm.

3. The apparatus for polishing an edge surface of a glass substrate for magnetic recording media according to the above 1 or 2, wherein the grindstone made of resin is a formed grindstone to simultaneously polish said outer edge surface and/or said inner edge surface, and chamfers.

4. A process for producing a glass substrate for magnetic recording media, which comprises polishing an outer edge surface and/or an inner edge surface of a glass substrate for magnetic recording media by pressing said outer edge surface and/or said inner edge surface against a grindstone made of resin, prepared by mixing abrasive grains to a resin, to finish so that the arithmetic average roughness (Ra) of said outer edge surface and/or said inner edge surface would be at most 100 nm.

The invention as defined in the above 1, 2 and 3, has been made on such a basis that in the polishing apparatus disclosed in Patent Document 1, the cause to hinder improvement of the productivity resides in the adoption of a free abrasive grain type polishing apparatus employing an abrasive for carrying out high precision polishing, and the cause for incapability of readily absorbing variations in the processing margins of glass substrates, resides in the adoption of batch treatment.

Firstly, in Patent Document 1, the outer edge surface is polished with high precision at a level of 10 nm by arithmetic average roughness (Ra). However, it has been found that the practical arithmetic average roughness (Ra) required for the production of hard disks may be at a level of at most 100 nm without any problem such as formation of dust, and at this level, mechanical polishing with high productivity is feasible by employing a grindstone made of resin (such as urea resin) having a hardness lower than the glass substrate, and that by suitably selecting the abrasive material (such as diamond) for the grindstone of resin, the abrasive grain size, the abrasive grain density, the abrasive hardness, the specification of the resin, etc., polishing can be accomplished so that the arithmetic average roughness (Ra) after the processing would be from 30 nm to 100 nm. Further, as such mechanical polishing is feasible, it has been found possible to adopt sheet treatment to increase the productivity and to eliminate variations in processing margins of the glass substrates caused by lamination polishing, and further, to absorb variations in dimensional precision of individual glass substrates.

According to the above 2, the polishing time by the grindstone made of resin at the third station is substantially equal to the grinding time at the second station in the previous step, and sheet processing is feasible, whereby mounting and dismounting of the glass substrate are carried out at the first station, the glass substrate is transferred from the first station to the second station by the transfer mechanism and then grinding is carried out; and then, the substrate is transferred from the second station to the third station, followed by polishing. At that time, the second glass substrate is subjected to grinding at the second station. The glass substrate after completion of polishing at the third station, is transferred by the transfer mechanism to the first station, then dismounted here and transferred to the next step. Accordingly, by the polishing apparatus as defined in the above 2, grinding and polishing by a grindstone made of resin can be carried out by a single polishing apparatus. Thus, as compared with the polishing apparatus disclosed in Patent Document 1, labor saving and space saving will be possible.

As disclosed in the above 3, in the polishing apparatus according to the above 1 or 2, the grindstone made of resin is preferably a formed grindstone to simultaneously polish the outer edge surface and/or the inner edge surface and chamfers of the glass substrate for magnetic recording media.

By employing a formed grindstone as the grindstone made of resin, the outer edge surface and/or the inner edge surface of the glass substrate, and the chamfers can simultaneously be polished, whereby the productivity will be further improved. Further, the groove of the formed grindstone may readily be formed into a shape whereby the entire edge surface and chamfers can uniformly be processed, by e.g. a method wherein a glass substrate to be processed is pressed against the grindstone made of resin, formed into a rod shape, with a force higher than the pressing force during the polishing, so that a concave recess is formed (transferred) on the surface of the rod shape grindstone made of resin. Whereas, in the polishing apparatus disclosed in the Patent Document 1, polishing is carried out by a brush, whereby the tip of the brush is hardly pressed against chamfers, and the chamfers cannot be polished with good precision.

As described above, by the apparatus for polishing an edge surface of a glass substrate for magnetic recording media and the process for producing a glass substrate according to the present invention, an outer edge surface and/or an inner edge surface of the glass substrate is polished by pressing the outer edge surface and/or the inner edge surface of the glass substrate against a grindstone made of resin, prepared by mixing abrasive grains to a resin, so that the arithmetic average roughness (Ra) of the outer edge surface and/or inner edge surface of the glass substrate would be at most 100 nm, whereby the productivity can be improved without formation of scars due to handling or without requiring extra effort.

In the accompanying drawings.

Figure 1:
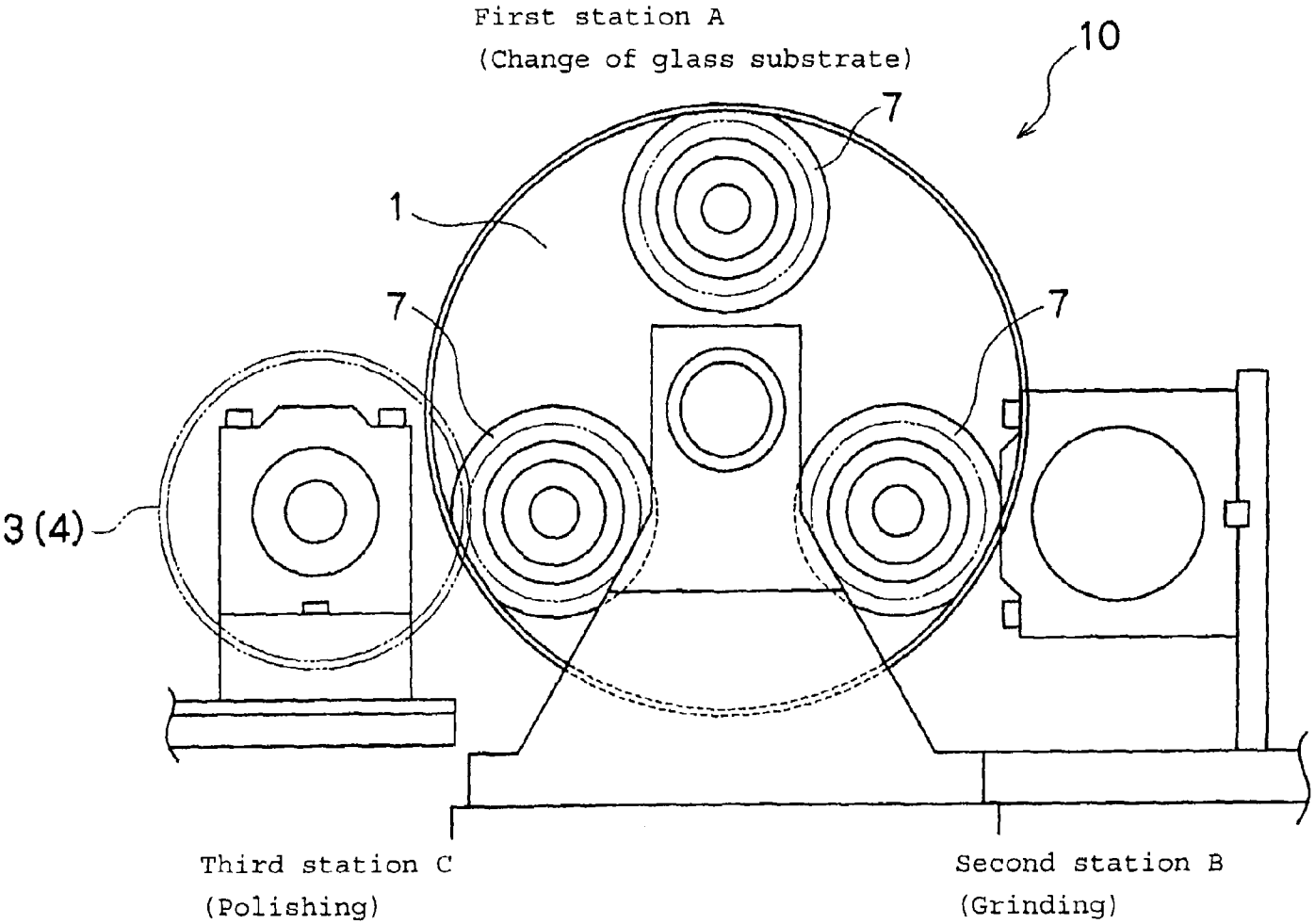
FIG. 1 is a view illustrating the construction of an embodiment of the apparatus for polishing a glass substrate.

In the Figs., reference numeral 1 represents a turn table, 2 a glass substrate, 3 a grindstone for grinding the outer edge surface, 4 a grindstone made of resin, 5 a grindstone for grinding an inner edge surface, 6 a grindstone for polishing an inner edge surface, 7 a holder, 10 an apparatus for polishing an edge surface of a glass substrate, 30 a stick-form grindstone, A a first station, B a second station and C a third station.

Now, preferred embodiments of the apparatus for polishing an edge surface of a glass substrate for magnetic recording media and the process for producing a glass substrate, according to the present invention, will be described in detail with reference to the accompanying drawings.

FIG. 1 is a view illustrating the construction of an embodiment of the apparatus 10 for polishing an edge surface of a glass substrate for magnetic recording media. The processing system by this apparatus 10 for polishing an edge surface is a system designed to simultaneously carry out, at different sites, at least a step to carry out mounting and dismounting of the glass substrate, a step to carry out rough grinding of inner and outer edge surfaces of the glass substrate and a step to carry out polishing of the inner and outer edge surfaces of the glass substrate, and to realize such a design, the system comprises a plurality of stations including at least a first station A to carry out mounting and dismounting of the glass substrate, a second station B to carry out rough grinding of the inner and outer edge surfaces of the glass substrate, and a third station C to carry out polishing of the inner and outer edge surfaces of the glass substrate, and a transfer mechanism to transfer the glass substrate mounted at the first station A sequentially via the above mentioned respective stations. Further, this processing system is designed so that the grinding and polishing of the edge surfaces of one glass substrate will be finished every time in a duration of the time for polishing which requires the longest operation time among the above three steps plus the time for one transportation between the stations.

One shown in FIG. 1 is the simplest three station type polishing apparatus 10. A first station A to carry out mounting and dismounting of a glass substrate, a second station B to carry out grinding of inner and outer edge surfaces of the glass substrate and a third station C to carry out polishing of inner and outer edge surfaces of the glass substrate, are arranged at equal intervals (360°/n where n is the number of stations, 120° in this case) on a turn table 1.

Figure 2:
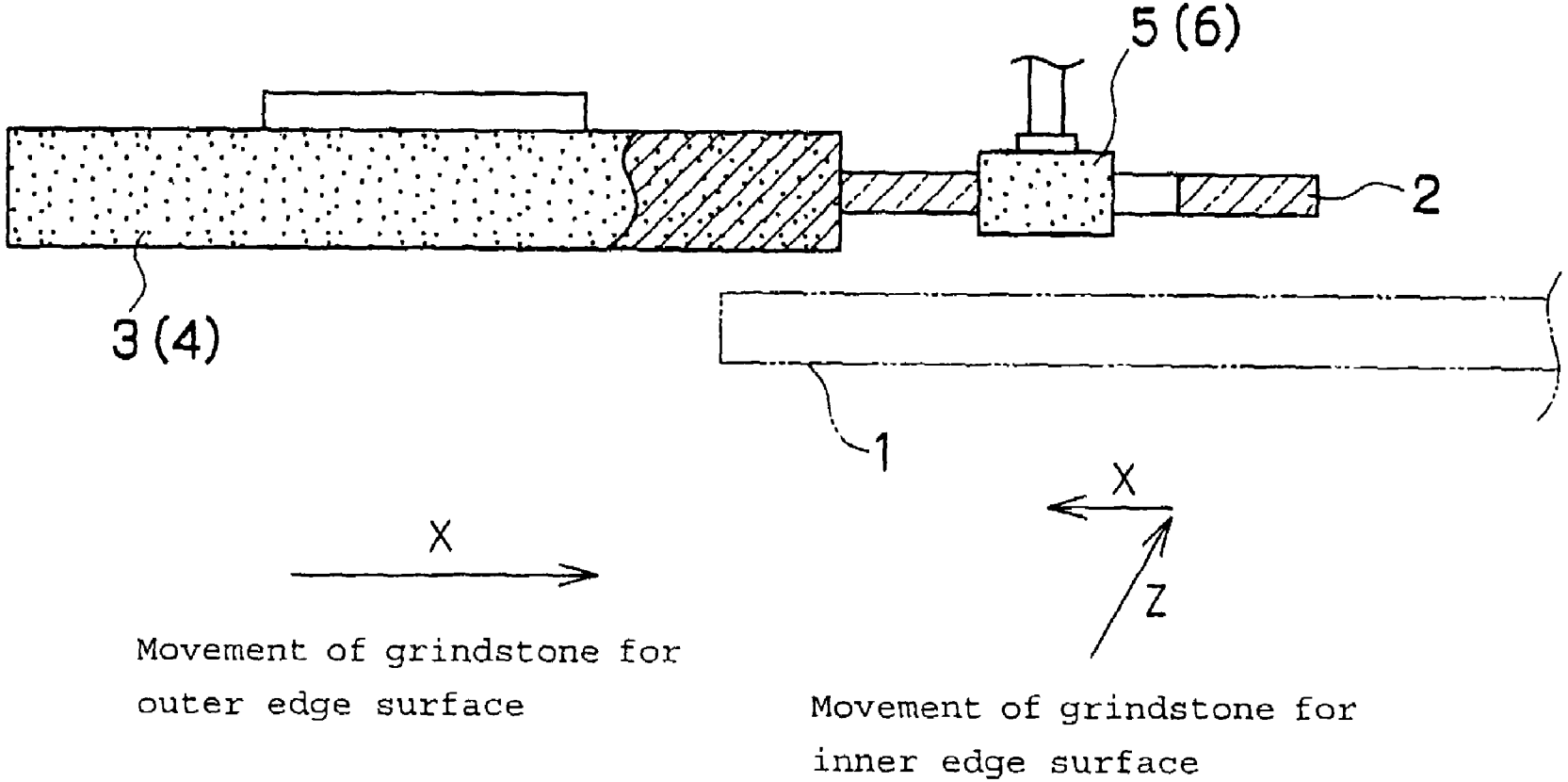
FIG. 2 is a view illustrating an embodiment of grinding/polishing to be carried out by the polishing apparatus shown in FIG. 1.

Glass substrates to be processed are rotatably supported by three glass substrate holders 7 disposed at the positions of 120° on this turn table 1. This turn table 1 is provided with a rotation driving mechanism, and the three glass substrate holders 7, 7 and 7 will be stepwise driven to correspond to the positions of the first station A, second station B and third station C, respectively. The timing of the stepwise driving is the above-mentioned time for polishing plus the time for one transfer between stations. Firstly, at the first station A, dismounting of a polished glass substrate and mounting of a non-polished glass substrate are carried out; at the second station B, grinding of inner and outer edge surfaces of the glass substrate is carried out, and at the third station C, polishing of inner and outer edge surfaces of the glass substrate is carried out, simultaneously in a parallel fashion. Grinding and polishing are carried out at different stations, and grinding stones are separately prepared as shown in FIG. 2, i.e. a grinding stone 3 for grinding the outer edge surface, a grinding stone 4 for polishing the outer edge surface, a grinding stone for grinding the inner edge surface, and a grinding stone 6 for polishing the inner edge surface. In the embodiment, the grinding stone 4 for grinding the outer edge surface and the grinding stone 6 for polishing the inner edge surface are grinding stones made of resin of the present invention, and accordingly, the grinding stone 4 for polishing the outer edge surface will be referred to the grinding stone 4 made of resin, and the grinding stone 6 for polishing the inner edge surface will be referred to as the grinding stone 6 made of resin. As such a grinding stone made of resin, one prepared by mixing diamond abrasive grains to a urethane resin or urea resin may, for example, be preferably used.

The glass substrate 2 is rotatably supported via the disk holder 7 on the turn table 1 and transferred sequentially in the order of stations A, B and C. And, at the second station B and the third station C, the inner edge surface and the outer edge surface of the glass substrate 2 are subjected to grinding and polishing in contact with the grinding stone for the respective grinding, and the grinding stone for the respective polishing, as shown in FIG. 2. The grindstone 3 for grinding the outer edge surface and the grindstone 4 made of resin are provided at the stations B and C, respectively, movable in the radial direction of the turn table 1 so that at the time of rotational movement of the table 1, they are retreated outwardly to be out of contact with the glass substrates 2 and at the time of processing, they are moved inwardly to be in contact with the glass substrates 2. As the mechanism for movement of the respective grindstones 3 and 4, servo motor air cylinders are respectively applied, so that in the grinding, the moving rate of the grindstone is freely adjusted, and in the polishing, constant pressure processing is realized by a constant air pressure by the air cylinder.

Further, the grinding stone 5 for grinding the inner edge surface and the grinding stone 6 made of resin are provided at the stations B and C, respectively, movably in a perpendicular direction to the plane of the turn table 1, so that at the time of movement of the turn table 1, they are retreated to positions not to hinder the rotation of the turn table 1, and in a state where the turn table 1 is stopped, the grinding stone 5 for grinding the inner edge surface and the grindstone 6 made of resin are driven so that they are located in the circular holes of the glass substrates 2 supported by the glass substrate holders 7. And, at the time of processing, they are moved in the radial direction of the turn table 1 so that they will be in contact with the inner edge surfaces of the glass substrates 2. The state shown in FIG. 2 is the state where the processing is being carried out, and the grinding stone 3 or 4 for processing the outer edge surface is moved in the direction shown by arrow X from the position retreated during the rotational driving of the turn table 1 and brought in contact with the outer edge surface of the glass substrate 2, and the grinding stone 5 or 6 for processing the inner edge surface is firstly moved in the direction shown by arrow Z to be located in the circular hole of the glass substrate 2 and then moved in the direction shown by arrow X to be in contact with the inner edge surface of the glass substrate 2. The grinding stone 3 or 4 for processing the outer edge surface and the grinding stone 5 or 6 for processing the inner edge surface both rotated at a high speed to grind or polish the outer edge surface and the inner edge surface of the glass substrate 2 in contact. The glass substrate 2 is rotationally driven at a low speed by a rotational driving mechanism of the glass substrate holder 7 at the station B or C, so that processing carried out over the entire edge surface of 360°. Such outer edge surface processing and inner edge surface processing are simultaneously carried out in a parallel fashion at the stations B and C, respectively.

The stations B and C are different in that the grinding stone to be used are for grinding and for polishing, respectively, but with respect to the mechanism, they are provided with similar driving mechanisms. Further, dismounting of a processed glass substrate 2 and mounting a non-processed glass substrate 2 to be carried out at the first station A, may be carried out by manual operation, but from the viewpoint of automatic efficiency, in this embodiment, a robot is provided.

In the above construction, at the first station A, a processed glass substrate 2 is dismounted by a robot mechanism, and instead, a non-processed glass substrate 2 is transported to the glass substrate holder 7. This glass substrate holder 7 is provided with a vacuum suction mechanism, and the non-processed glass substrate 2 is securely held by the operation of the vacuum suction mechanism. Here, the glass substrate 2 thus held is required to be located accurately at the concentric position to the rotational axis of the glass substrate holder 7 throughout the grinding and polishing at the stations B and C. This is required so that the inner and outer edge surfaces are accurately concentrically processed in the grinding and polishing at the stations B and C. For this purpose, precision in the transport positioning of a non-processed glass substrate 2 on the glass substrate holder 7 by the above-mentioned robot, and to carry out grinding by maintaining the concentric position obtained by the grinding by eliminating a change of the glass substrate holder during the transportation between the stations B and C, become important.

At the second station B, when the glass substrate held by the glass substrate holder 7 is brought by the rotation of the turn table 1, a coupling relation is taken between the rotation mechanism (not shown) to rotate the glass substrate 2 at a low speed and the glass substrate holder 7. This can be carried out by a clutch mechanism (not shown), so that during the rotation of the turn table 1, the coupling is released, and when the turn table stops at the station position, the coupling is effected to make rotation of the glass substrate 2 by the above rotation mechanism possible. The above clutch mechanism is provided in the same manner also at the third station C, to make rotation of the glass substrate 2 by the rotation mechanism via the clutch mechanism possible.

In the above embodiment, a turn table 1 is shown as the transfer mechanism to sequentially transfer the glass substrate 2 via the respective stations A, B and C. However, the transfer mechanism is not limited thereto so long as it is a mechanism wherein the means for transfer between the respective stations A, B and C are driven simultaneously with one another and the glass substrate 2 to be transferred will return to the initial mounting position. A suitable conveyer may be employed.

In the polishing apparatus 10 of the embodiment, a mechanical polishing method by means of the grinding stones 4 and 6 made of resin is employed in the steps for polishing the outer and inner edge surfaces of the glass substrate 2. This is based on the following viewpoint.

In the polishing apparatus disclosed in Patent Document 1, the cause to hinder improvement of the productivity resides in that a chemical polishing apparatus employing an abrasive for high precision polishing is employed, and the cause for being incapable of readily absorbing variations in the processing margins of the glass substrates, resides in that batch treatment is adopted.

In Patent Document 1, the outer edge surface is polished to a high level of precision of about 10 nm by arithmetic average roughness (Ra). However, it has been found that when hard disks are produced by using glass substrates, if the arithmetic average roughness (Ra) of the inner and outer peripheral edge surfaces of the glass substrates is at a level of at most 100 nm, there will be practically no problem such as formation of dust. And, it has been found that at this level, mechanical polishing with high productivity is feasible by using a grindstone made of a resin (such as a urea resin or a urethane resin) having a hardness lower than the glass substrate and that by properly selecting the abrasive grain material (such as diamond abrasive grains) for the grindstone of resin, the abrasive grain size, the abrasive grain density, the abrasive grain hardness, the specification of the resin, etc., it is possible to accomplish polishing so that the arithmetic average roughness (Ra) after the processing would be from 30 nm to 100 nm.

Furthermore, it has been found that since the mechanical polishing is feasible, sheet treatment can be adopted to increase the productivity and at the same time to eliminate variations in the processing margins of the glass substrates caused by lamination polishing, and with respect to variations in the dimensional precision of individual glass substrates, so that such variations can be absorbed, the grindstone is made to be a grindstone 4 made of a resin (such as a urea resin or a urethane resin) having a hardness lower than the glass substrate 2. By properly selecting the abrasive grain material (such as diamond abrasive grains) for the grindstone 4 made of resin, the abrasive grain size, the abrasive grain density, the abrasive grain hardness, the specification of the resin etc., it is possible to accomplish polishing so that the arithmetic average roughness (Ra) after the processing would be from 30 nm to 100 nm.

Figure 3:
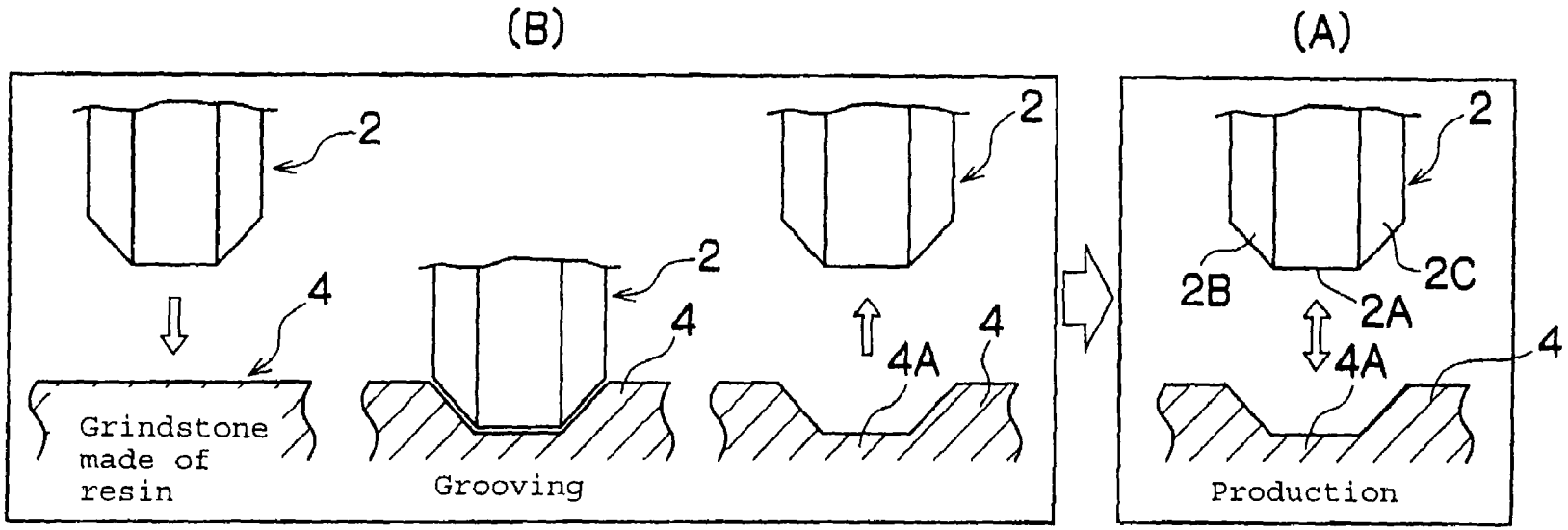
FIG. 3 is a view illustrating a formed grindstone prepared from a grindstone made of resin, to polish the outer periphery of a glass substrate.

And, the grindstone 4 made of resin is preferably a formed grindstone having a groove 4A formed to simultaneously polish the outer edge surface 2A of the glass substrate 2 and chamfers 2B and 2C on both sides thereof, as shown in FIG. 3(A). By adopting such a formed grindstone as the grindstone 4 made of resin, it is possible to simultaneously polish all of the outer edge surface 2A and the chambers 2B and 2C on both sides thereof, of the glass substrate 2, whereby the productivity and uniformity in processing will further be improved.

Further, the shape (the grindstone shape) of the groove 4A of the formed grindstone can easily be formed by pressing the peripheral edge portion of the glass substrate 2 to be processed to a grindstone 4 made of resin formed into a rod shape wherein a groove 4A is not yet formed, with a force higher than the pressing force during the polishing, as shown in FIG. 3(B), whereby the surface of the grindstone 4 made of resin in a rod shape will be recessed in a concave shape (transferred) to readily form a groove 4A in conformity with the peripheral edge shape of the glass substrate 2.

Figure 4:
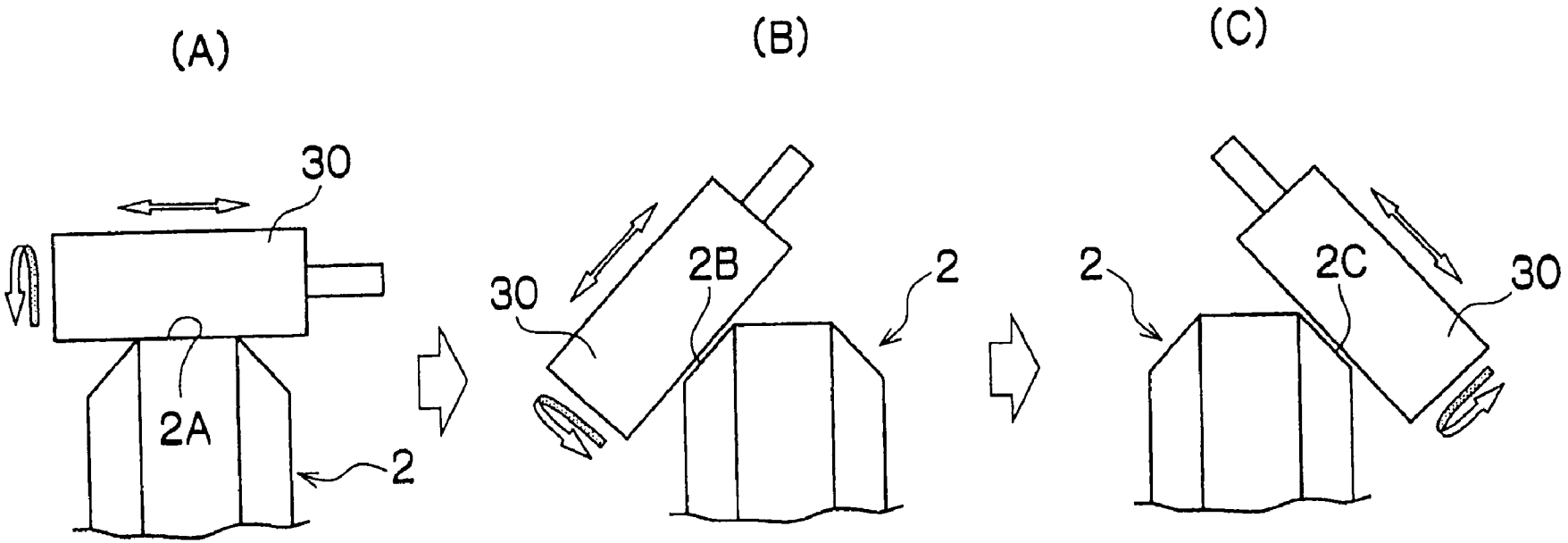
FIG. 4 is a view illustrating a stick-form grindstone prepared from a grindstone made of resin, to polish the outer periphery of the glass substrate.

The grindstone 4 made of resin is not limited to a formed grindstone, and a stick-form grindstone 30 as shown in FIG. 4 may also be employed. In such a case, as shown in FIG. 4(A), the surface of the stick-form grindstone 30 is pressed against the outer edge surface 2A of the glass substrate 2 and the stick-form grindstone 30 is reciprocated along its axial direction, to polish the outer edge surface 2A of the glass substrate 2. Then, as shown in FIG. 4(B), the stick-form grindstone 30 is inclined so that the surface of the stick-form grindstone 30 is pressed against a chamfer 2B of the glass substrate 2 and the stick-form grindstone 30 is reciprocated along its axial direction, to polish the chamfer 2B of the glass substrate 2. Then, as shown in FIG. 4(C), the stick-form grindstone 30 is inclined in the opposite side so that the surface of the stick-form grindstone 30 is pressed against a chamfer 2C of the glass substrate 2 and the stick-form grindstone 30 is reciprocated in its axial direction to polish the chamfer 2C of the glass substrate 2. Thus, the polishing step of the glass substrate 2 is completed.

The entire disclosure of Japanese Patent Application No. 2005-111104 filed on Apr. 7, 2005 including specification, claims, drawings and summary are incorporated herein by reference in its entirety.

What is claimed:

1. A process for producing a glass substrate for magnetic recording media, comprising:

pressing the glass substrate into a resin of a solid rod-shaped grindstone with a force higher than a pressing force to be used during polishing, said resin having a hardness less than that of the glass substrate;

from said pressing, forming a reentrant groove in conformity with a peripheral edge portion of the glass substrate; and polishing an outer edge surface and/or an inner edge surface of the glass substrate for magnetic recording media by pressing at a lower polishing force than said higher force said outer edge surface and/or said inner edge surface against the rod-shaped grindstone within the reentrant groove, the grindstone being made of resin, prepared by mixing abrasive grains to the resin, so that the arithmetic average roughness (Ra) of said outer edge surface and/or said inner edge surface is from 30 nm to 100 nm after polishing.

2. The process according to claim 1, further comprising:

polishing with said grindstone said outer edge surface to an arithmetic average roughness (Ra) from 30 nm to 100 nm.

3. The process according to claim 1, wherein the polishing comprises polishing with said rod-shaped grindstone comprising at least one of an urethane or urea resin.

* * * * *